US007614617B2

(12) United States Patent
Marusiak

(10) Patent No.: US 7,614,617 B2
(45) Date of Patent: Nov. 10, 2009

(54) AUTO-ADVANCE BAR CLAMP

(76) Inventor: Frank Marusiak, 701 Kline Pl., Bridgewater, NJ (US) 08807

( * ) Notice: Subject to any disclaimer, the term of this patent is extended or adjusted under 35 U.S.C. 154(b) by 0 days.

(21) Appl. No.: 12/048,928

(22) Filed: Mar. 14, 2008

(65) Prior Publication Data

US 2008/0157450 A1 Jul. 3, 2008

Related U.S. Application Data

(63) Continuation of application No. 11/163,831, filed on Nov. 1, 2005, now abandoned.

(51) Int. Cl.
*B25B 1/00* (2006.01)

(52) U.S. Cl. ..... 269/6; 269/166; 269/3

(58) Field of Classification Search ..... 269/6, 269/3, 170, 166, 171.5
See application file for complete search history.

(56) References Cited

U.S. PATENT DOCUMENTS 4,220,322 A * 9/1980 Hobday ..... 269/6
5,161,787 A * 11/1992 Hobday ..... 269/6
6,568,667 B1 * 5/2003 Hall ..... 269/6
6,648,315 B1 * 11/2003 Lee ..... 269/6
2006/0091596 A1 * 5/2006 Marusiak ..... 269/6
2008/0157450 A1 * 7/2008 Marusiak ..... 269/6

* cited by examiner

*Primary Examiner*—Lee D Wilson
(74) *Attorney, Agent, or Firm*—Barnes & Thornburg LLP; Glenn W. Ohlson

(57) ABSTRACT

A multi-range auto-advance bar clamp used for clamping work pieces together which may upon release of the brake instantly and automatically adjust from a wide open position to any desired closed position. The multi-range auto-advance bar clamp may comprise a slide bar, a movable jaw, a sliding jaw, a body, a drive assembly and a brake, an advancement mechanism, a rigid structural body extension and a slide rail. The jaws of the clamp are adjustably separated and positioned about a work piece. A mechanism for controlling the speed with which the clamp automatically closes may also be provided.

18 Claims, 15 Drawing Sheets

AUTO-ADVANCE BAR CLAMP

RELATED APPLICATION

This application is a continuation of co-pending U.S. patent application Ser. No. 11/163,831 filed Nov. 1, 2005.

BACKGROUND ART

The present invention relates to a bar clamp. Specifically a bar clamp that automatically adjusts from a wide-open position to the desired clamping position by releasing a braking lever. The bar clamp may then be tightened to the final clamping position by a few squeezes of the trigger.

Bar clamps which allow the user to tighten the clamp about a work piece using only one hand are well known. Although it is true that such clamps permit the user to advance closing of the clamp by holding and squeezing a trigger type mechanism using only one hand, there typically remains a need to use two hands to pre-adjust the distance between the jaws to an approximate position in order to efficiently use the clamp. Adjusting the jaws of such clamps to a desired position often cannot be easily accomplished by merely squeezing the trigger, each squeeze of the trigger only advances the movable jaw in small increments.

DISCLOSURE OF INVENTION

The auto-advance bar clamp of the present invention permits the user to automatically adjust the clamp from a wide open position to any desired closed position instantly by simply pressing a brake lever. Upon release of the brake, a spring loaded slide bar and movable jaw of the auto-advance bar clamp instantly and automatically advance to the desired closed position requiring only a few squeezes of the trigger to tighten the clamp. This instant adjustment of the clamp is accomplished with only one hand leaving the other hand free to hold the work.

Typically, one-handed bar clamps require their overall length to be longer than their clamping capacity, for example a 6" capacity clamp is about 13" long and a 12" capacity clamp is about 19" long. In one embodiment, substantial reduction of the overall length of the clamp relative to its clamping capacity is accomplished. In this multi-range embodiment the overall length of the clamp is actually shorter than its maximum clamping capacity providing a more compact tool while more than doubling its clamping capacity. For example, this embodiment of the clamp with an overall length of 12" would actually have a clamping capacity of 14". The multi-range embodiment includes a rigid structural body extension with a slide rail and a sliding jaw mounted upon the slide rail. The sliding jaw can be slid along the slide rail and maintained at pre-determined locking locations along the rail resulting in a multi-range clamp of substantially longer clamping capacity. Although desirable, this multi-range embodiment need not incorporate the auto-advance feature.

BRIEF DESCRIPTION OF THE DRAWINGS

FIG. 4A is a side view of an end cap as shown in FIG. 4.

FIG. 4B is a front view of the end cap.

FIG. 4C is a back view of the end cap.

BEST MODES(S) FOR CARRYING OUT THE INVENTION

Figure 9:
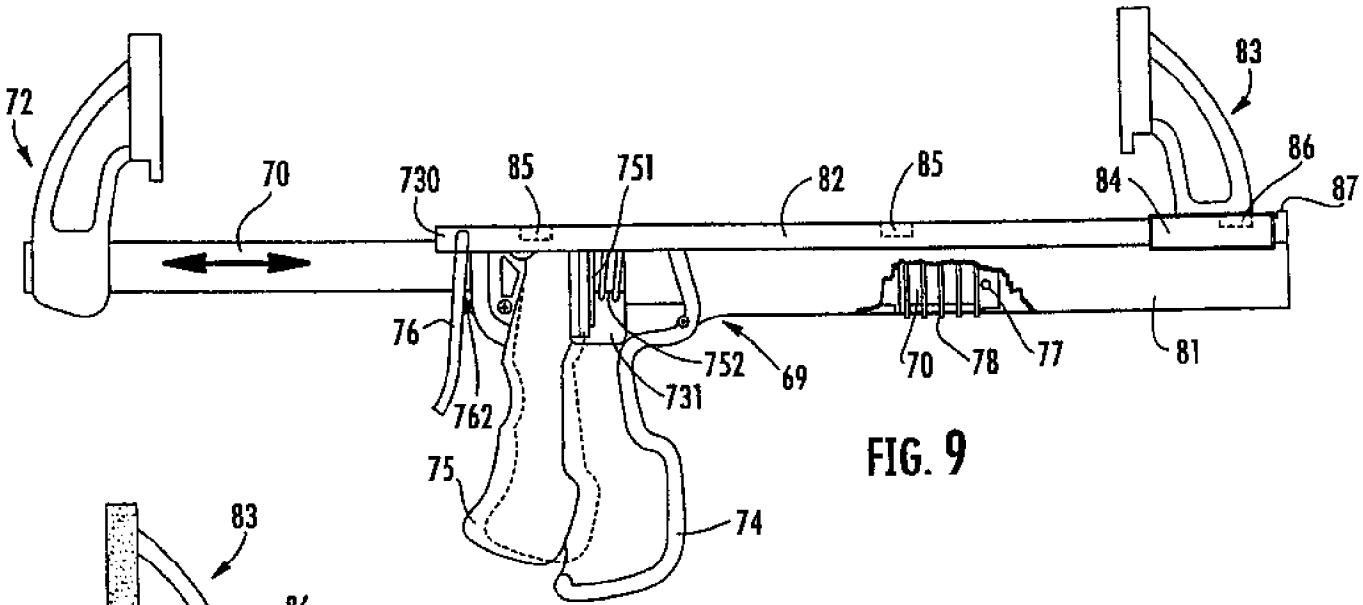
FIG. 9 is a side view (with a cutaway section for clarity) of a preferred embodiment multi-range auto-advance bar clamp shown with the sliding jaw in at a wide open position.
Figure 10:
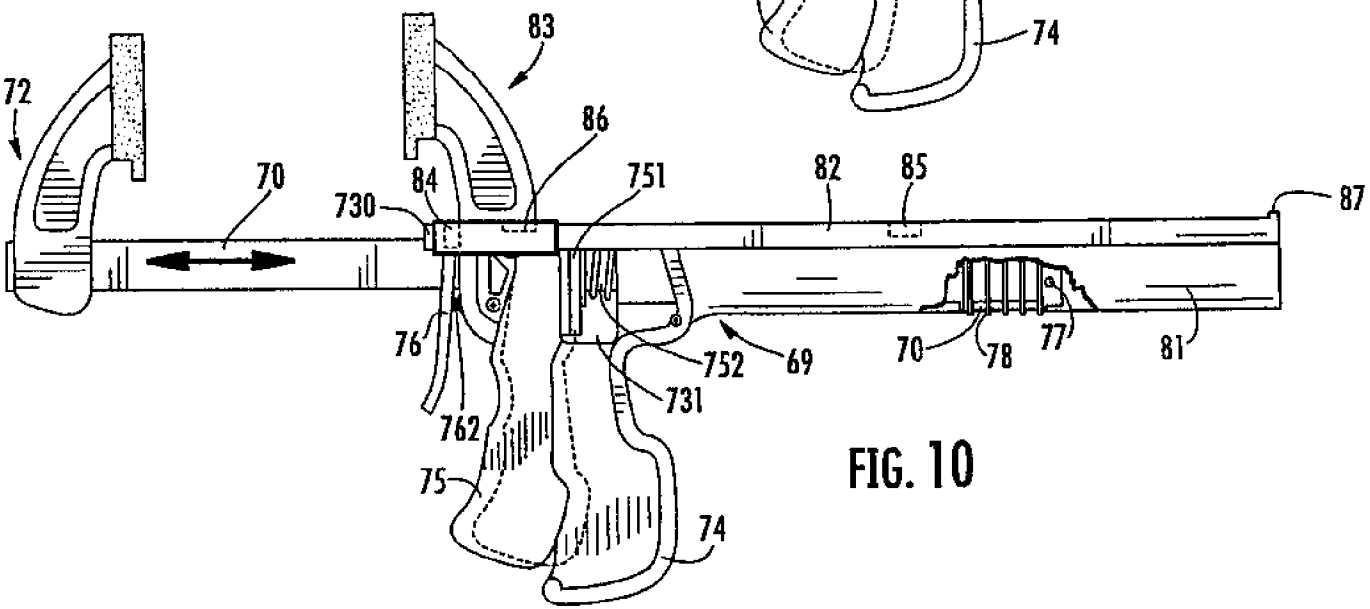
FIG. 10 is a view of the clamp of FIG. 9 showing the clamp with the sliding jaw at the smaller range position.

A one handed multi-range auto-advance bar clamp used for damping work pieces together which will upon release of the brake (76) instantly and automatically adjust from a wide open position to any desired closed position is provided. With reference to FIG. 9 and FIG. 10 the multi-range auto-advance bar clamp comprises a slide bar (70), a movable jaw (72), a sliding jaw (83), a body (69), a drive assembly, a brake (76), an advancement spring (78), a rigid structural body extension (81) and a slide rail (82). The moveable jaw (72) opposes the sliding jaw (83) and is mounted at one end of the spring (78) loaded slide bar (70) and is movably mounted through the body (69). The slide bar (70) has a top edge and a bottom edge. The sliding jaw (83) is movably mounted upon the slide rail (82) and opposes the movable jaw (72). The sliding jaw (83) can be moved to and maintained by locking slots (86) located at pre-determined locations on top of the slide rail (82) providing multiple clamping ranges.

The body (69) has a top, a bottom, a front edge, a back edge, a bore (not numbered), a cavity (731), a handle (74), a rigid structural body extension (81), a slide rail (82) and a transverse brake slot (730). The cavity (731) is defined in the body (69) and divides the bore, the slide bar (70) passes through the cavity (731) and the bore. The transverse brake slot (730) is formed in the front end of the slide rail (82) above the slide bar (70). The handle (74) is formed at the bottom of the body (69).

The rigid structural body extension (81) is formed in cross section as a channel with the base of the channel providing the top section slide rail (82). The slide bar (70) and the advancement spring (78) travel freely with clearance on all sides parallel to the inner walls and top of the channel. The rigid structural body extension (81) also provides cover for the slide bar (70) and advancement spring (78) performing as a guard. As best illustrated in cross section FIGS. 12A and 12B the top section of the channel (82*a*) extends beyond the two channel legs (82*b*), the underside of the extensions provide gripping surfaces for the sliding jaw base (84) which wraps around the extensions maintaining the sliding jaw (83) snugly yet movably mounted upon the slide rail (82). The sliding jaw base (84) mounts on top of the slide rail (82) and is formed to closely mate with and contact the top, the sides and the underside of the channel extensions which protrude beyond the channel legs. The sliding jaw (83) is movable along the entire length of the slide rail (82) and retained at pre-determined positions by locking slots (85) formed in the top side of slide rail (82), the locking slots (85) prevent the sliding jaw (83) from moving unintentionally backward. The sliding aw (83) and locking slots (85) permit multiple clamping ranges.

Figure 12:
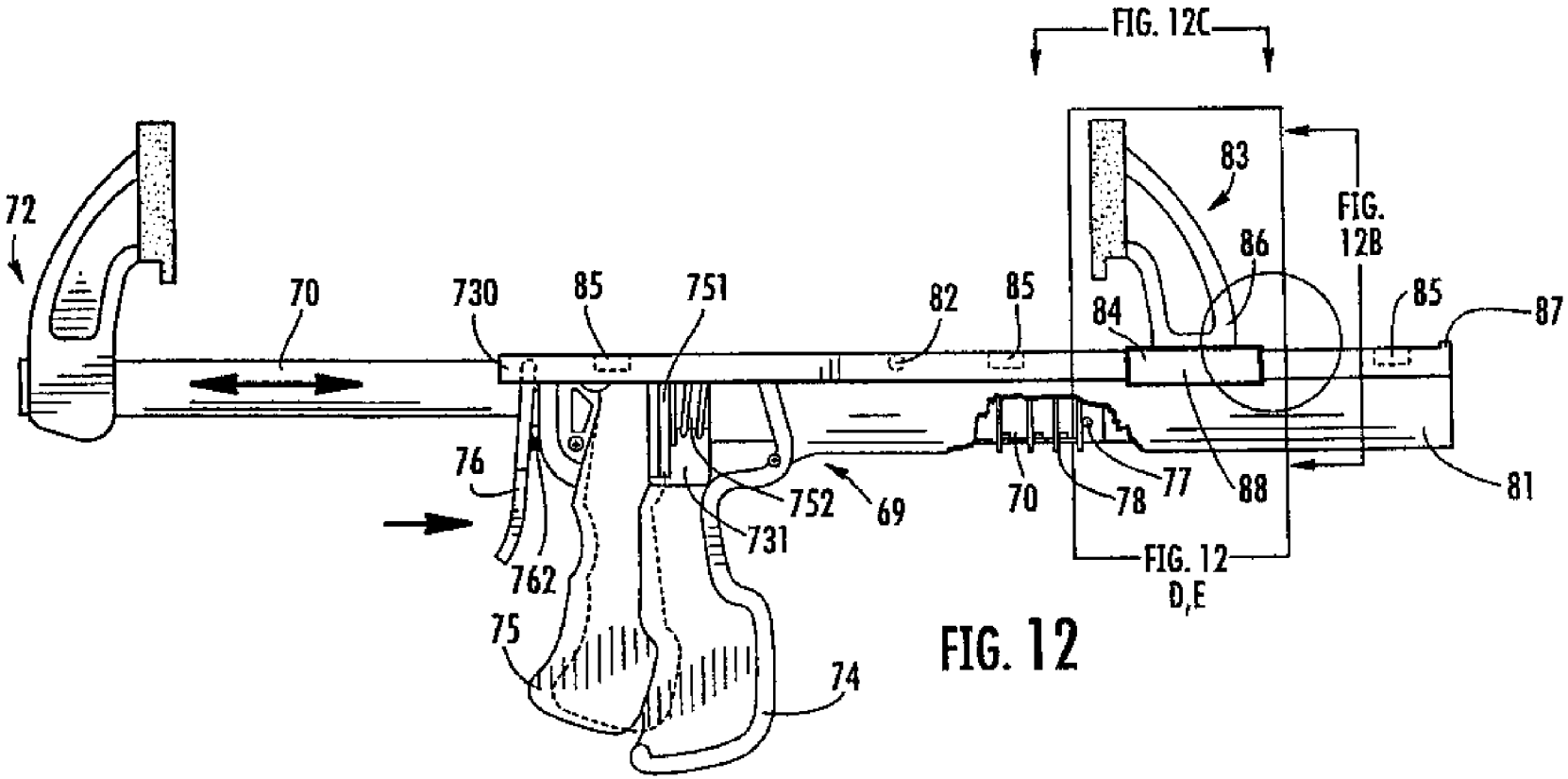
FIG. 12 is a side view of the FIGS. 9-11 clamp highlighting the tilting sliding jaw.
Figure 12C:
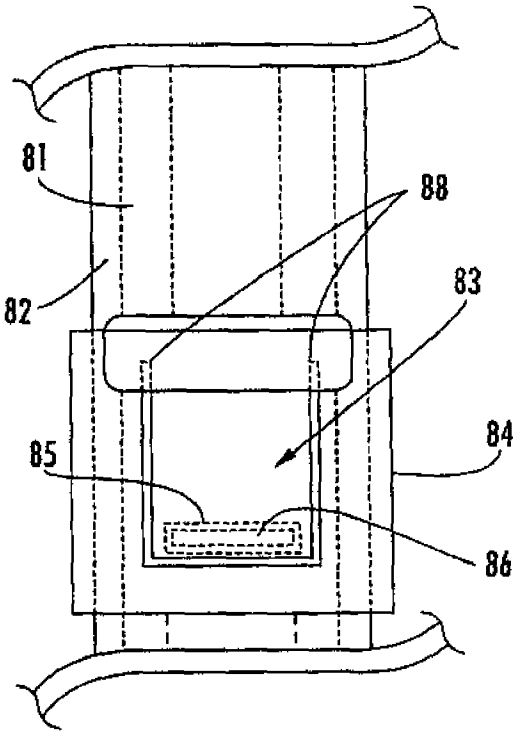
FIG. 12C is a top view of the section shown in FIG. 12A.
Figure 12B:
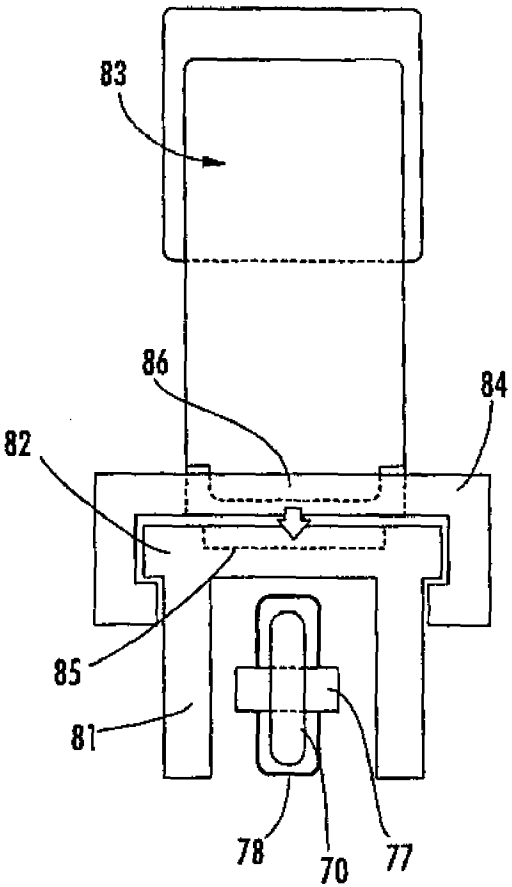
FIG. 12B is a view of the FIG. 12A clamp shown with the sliding jaw in the unlocked slide rail position.
Figure 12A:
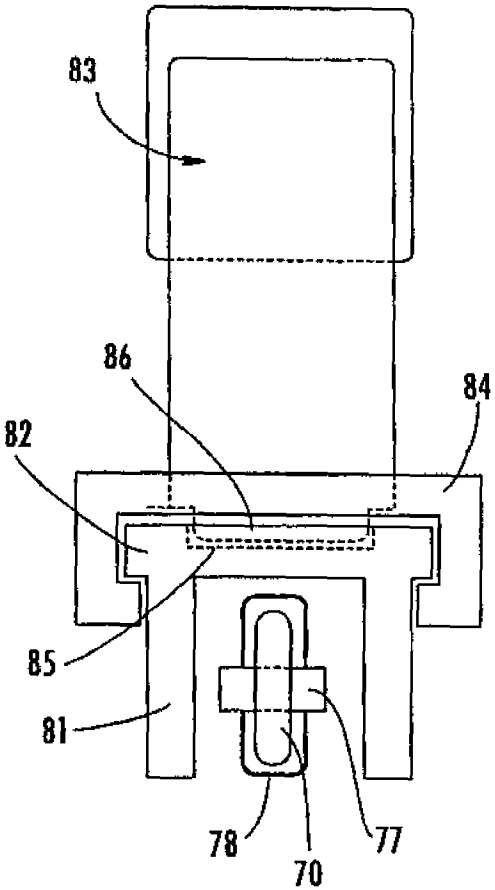
FIG. 12A is a cross section end view of the sliding jaw section of the FIG. 12 clamp shown in the locked slide rail position.
Figure 12G:
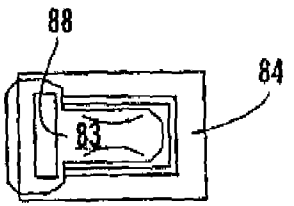
FIG. 12G is the same top view as FIG. 12F with more clarity.
Figure 12F:
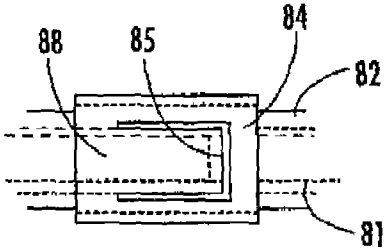
FIG. 12F is a top view of the section shown in FIG. 12D (without the top jaw section for clarity) showing the top of the sliding jaw base.
Figure 12I:
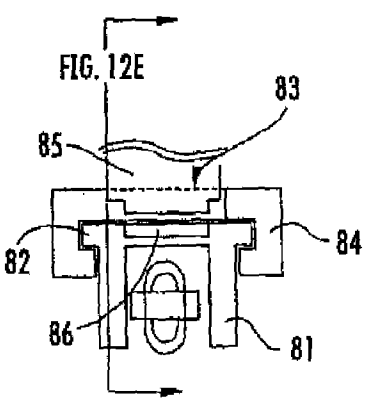
FIG. 12I is a cross section end view as FIG. 12H shown in the unlocked position.
Figure 12H:
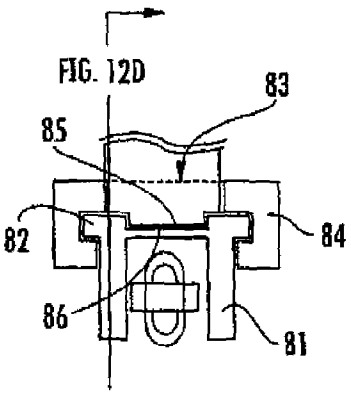
FIG. 12H is a cross section end view of the sliding base shown in FIG. 12D shown in the locked position.
Figure 12D:
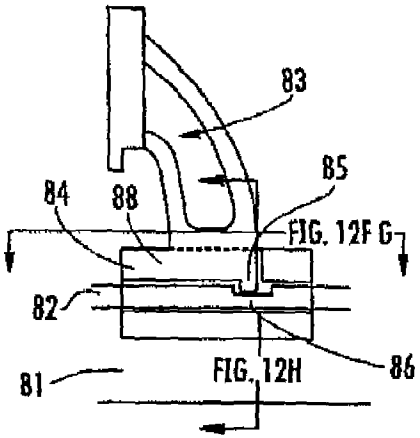
FIG. 12D is a side view cross section cut along the lines shown in FIGS. 12H and 12I of the sliding jaw shown in FIGS. 9-12 showing the jaw in the locked position.

As best illustrated in FIGS. 12D, E, H and I sliding jaw (83) is formed to include projection (85) which is resiliently maintained within the locking slots (85). The slide rail (82) begins in front of the transverse brake slot (730) and extends back and connects to the top of body (69), the slide rail (82) continues back connected to the top edges of the channel legs to form the hollow channel shaped rigid structural body extension (81). The rigid structural body extension (81) connects to and extends from the back of the body (69) terminating at or beyond the end of the slide bar (70) when the slide bar (70) is in the fully closed position with the movable jaw (72) closest to the body (69).

The drive assembly comprises a trigger (75), a drive lever (751) and a spring (752). The trigger (75) has a top, a bottom, a front edge and a rear edge and is pivotally mounted in the body (73) corresponding to the handle (74) so the top of the trigger (75) is in the cavity (731). The upper end of the trigger (75) is forked and straddles the slide bar (70). The handle (74) is hollow in part so as to receive the basically U-shaped trigger (75) when the trigger (75) is squeezed it straddles the handle (74). The drive lever (751) has a front surface, a rear surface and a hole (not numbered) through which the slide bar (70) passes, is suspended on the slide bar (70) and abuts the rear edge of the trigger (75). The hole of the drive lever (751) has a top edge and a bottom edge. The spring (752) has two ends and is mounted around the slide bar (70) in the cavity (731). One end of the spring (752) abuts the drive lever (751), and the other abuts an interior surface of the cavity (731) so the drive lever (751) is pushed to a non-gripping standby position substantially perpendicular to the slide bar (70). The trigger (75) is also pushed by the spring (752) to the standby position.

The brake (76) has a central hole and is pivotally retained within the transverse brake slot (730) in the front edge of the slide rail (82). The slide bar (70) passes through the central hole in the brake (76). The central hole in the brake (76) has a top edge and a bottom edge. A compression spring (762) is mounted between the brake (76) and the front edge of the body (69) so the brake (76) is pushed to a gripping inclined standby position.

The advancement spring (78) has two ends and is mounted around the slide bar (70). One end of the advancement spring (78) abuts the back edge of the body (69) and the other abuts a roll pin (77) which is pressed through a hole at the end of the slide bar (70) opposite the movable jaw (72). When the movable jaw (72) is furthest from the body (69) the clamp is in the open position and the advancement spring (78) is fully compressed, at lesser openings the advancement spring (78) is compressed relative to the degree of spacing between the movable jaw (72) and the front of the body (69). When the movable jaw (72) is closed and nearest the body (69) the advancement spring (78) is expanded however it is never fully expanded requiring greater overall length to fully close the clamp. The advancement spring (78) applies enough force to completely close the clamp from any open position but not enough force to overcome the grip of the brake (76).

With reference to FIG. 9 sliding jaw (83) is shown at its maximum range position and in FIG. 10 sliding jaw (83) is shown at its minimum range position. As best illustrated in FIG. 12D with projection (86) resiliently snapped within locking slot (85) which is formed on the top side of the slide rail (82) sliding jaw (83) is held in position. When clamping pressure is applied to sliding jaw (83) the back side of projection (86) is pushed against the back wall of locking slot (85) preventing backward movement of sliding jaw (83) along slide rail (82). Projection (86) or locking slot (85) may be formed with front sides angled or rounded (not shown) to permit passive forward movement of the sliding jaw (83) when desired. As shown in FIG. 12 sliding jaw (83) may be moved to different range positions along the slide rail (82) by slightly tilting the top portion of sliding jaw (83) forward in the direction of the movable jaw (72) thereby lifting the projection (86) out of the locking slot (85) and then sliding jaw (83) to a new position along the slide rail (82).

As shown in FIGS. 12D, F and G sliding jaw (83) and jaw base (84) may be formed as one piece with the only solid connection point between jaw base (84) and sliding jaw (83) located at the front side the remaining sides of jaw base (84) and sliding jaw (83) are unconnected.

Figure 11:
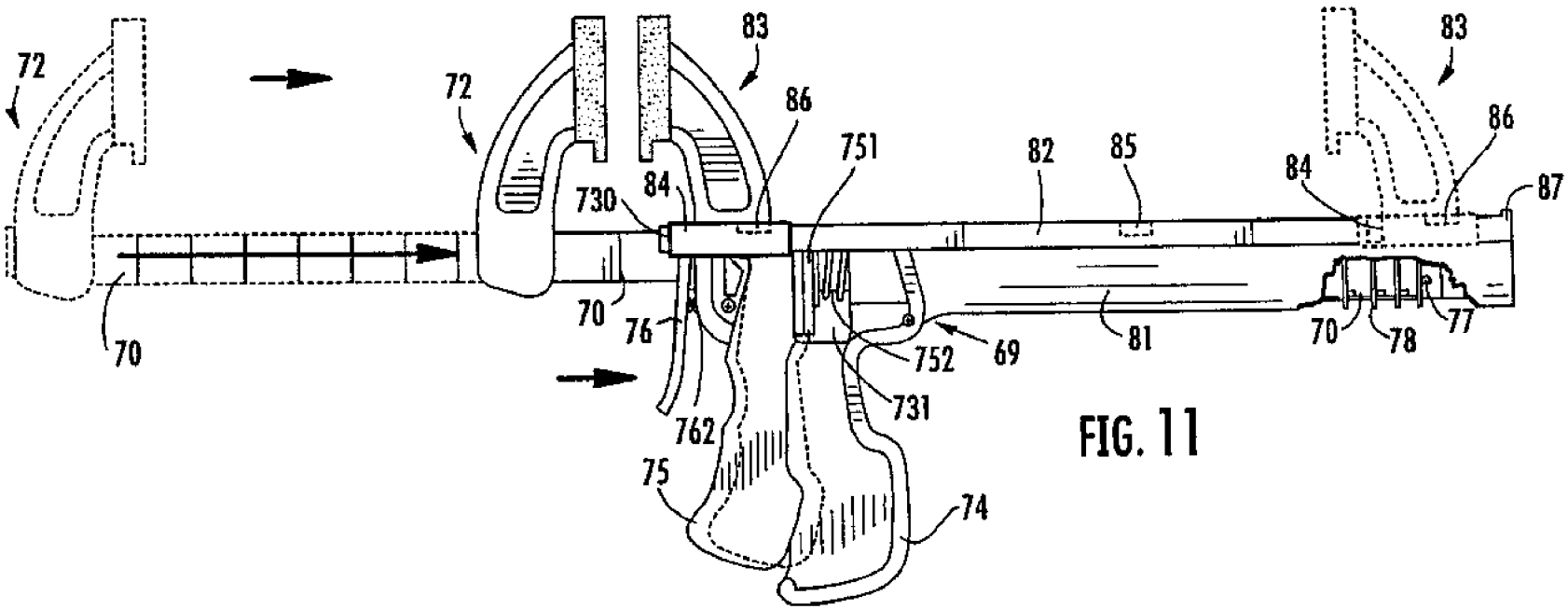
FIG. 11 is a view of the FIG. 9 and FIG. 10 clamp showing motion.
Figure 12E:
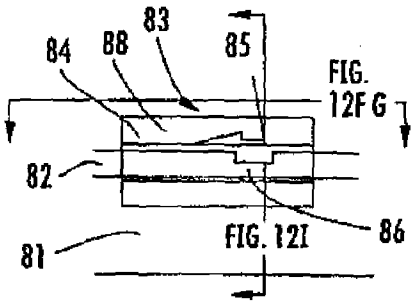
FIG. 12E is the same section as in FIG. 12D (upper section of the jaw not shown) with the jaw in the unlocked position.

As best shown in FIGS. 12E, F and G the one-sided connection point forms an integral resilient pivot point (88) which permits sliding jaw (83) to bend slightly at pivot point (88) when forward pressure is applied to the top of the sliding jaw (83). Upon release of forward pressure the resilient downward tendency permits the projection (86) to passively locate the desired locking slot (85) as the sliding jaw (83) is moved along the slide rail (82). A jaw stop (87) may be provided to prevent unintentional disengagement of jaw base (84) from slide rail (82). Referencing FIG. 11 it should be noted that the opening capacity of the clamp is more than doubled when the movable jaw (72) is fully extended away from the body (69) and the sliding jaw (83) is at its maximum range end position. It should also be noted that the locking slots (85) should be located at predetermined locations which provide all inclusive range. For example, if the range of the clamp with the sliding jaw (83) at minimum position provides clamp capacity of 0" to 6" the next range should provide clamp capacity of 6" to 12" and the maximum may be 8" to 14". Two or three locking slots (85) are preferable to serrations or multiple repeated slotting because it simplifies locating the sliding jaw (83) and eliminates guessing which locking slot (85) location along the slide rail (82) to choose. Simple visual comparison of the opening between the movable jaw (72) in the open most position and the sliding jaw (83) in any of the two or three range positions informs the user which of the locking slots (85) to use.

To advance the movable jaw (72) in small increments toward the sliding jaw (83), the trigger (75) is squeezed toward the handle (74), and the trigger (75) pivots the drive lever (751). The hole in the drive lever (751) is inclined so the top and bottom edge of the hole grip the top and bottom of the slide bar (70) and push the slide bar (70) back. As the drive lever (751) pushes the slide bar (70) back, the movable jaw (72) moves toward the sliding jaw (83). The slide bar (70) is kept from moving forward or unintentionally backward by the brake (76) because the central hole in the brake (76) grips the top edge and the bottom edge of the slide bar (70) when the trigger (75) is released. The compression spring (762) keeps the brake (76) in position to grip the slide bar (70) to prevent the slide bar (70) from moving forward or unintentionally backward.

To instantly close the clamp and advance the movable jaw (72) from any open position, toward the sliding jaw (83), the brake (76) is momentarily released. Instantly upon release of the brake (76) the advancement spring (78) expands and pushes against the back edge of the body (69) and the roll pin (77), the spring loaded slide bar (70) now free from the grip of the brake (76) is forced back instantly closing the clamp. Squeezing the trigger (75) tightens the clamp.

Figure 17:
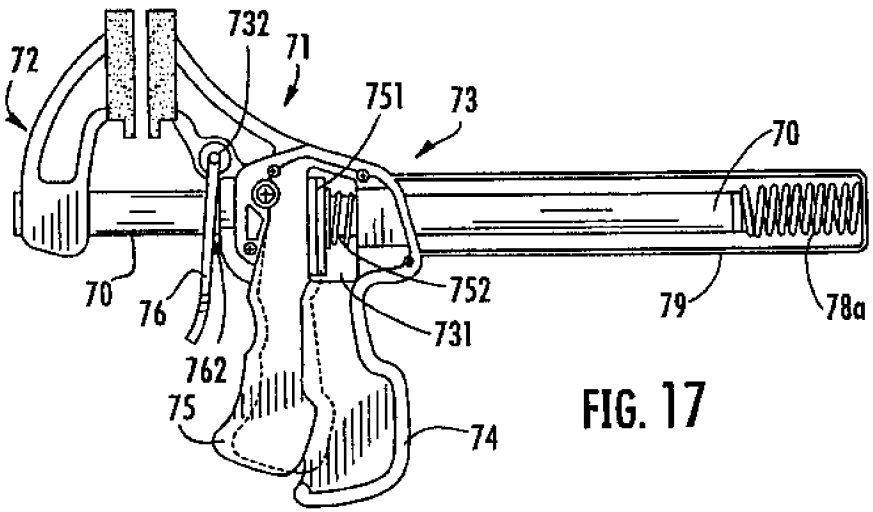
FIG. 17 is a partial cross section view similar to shown in FIG. 5 with an alternate advancement spring arrangement.
Figure 18:
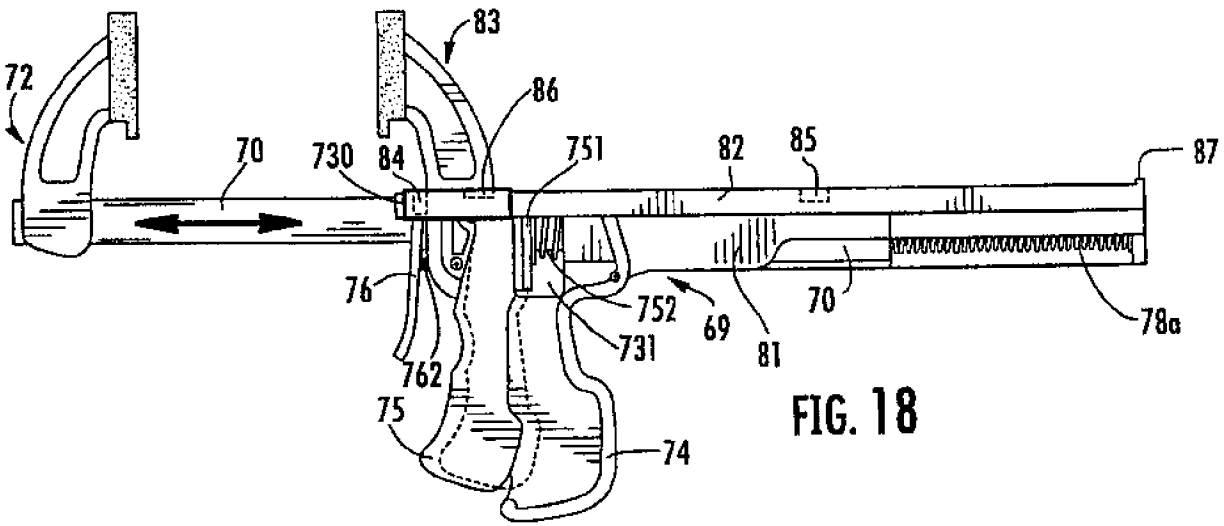
FIG. 18 is a partial cross section view similar to shown in FIG. 10 with an alternate advancement spring arrangement.

It should be noted that although the advancement spring (78) is described in all embodiments as mounted around the slide bar (70) and as expanding and pushing the slide bar (70) alternatives exist. For example, referring to FIGS. 17 and 18 constant force springs or extension springs (78*a*) may be mounted within embodiments having guards (79) or body extensions (81) such springs would pull instead of push the slide bar (70). Additionally for example, with reference to FIG. 13 compression springs (91) (or even a single spring, not shown) may be mounted within a guard or body extension (90) in a fashion to push the slide bar (70) similar to the advancement spring (78) but need not be mounted around the slide bar (70). Also, as illustrated for example in FIG. 14 alternate sliding jaw (92) and varied cross sectional body extensions (94) may be used including tubular (not shown).

It should also be noted that although FIGS. 9, 10, 11 and 12 describe a multi-range auto-advance bar clamp, it is understood that the clamp could also function as a multi-range one handed bar clamp even without the auto-advance feature simply by eliminating the advancement spring (78) and squeezing the trigger (75) to manually advance the movable jaw (72).

Figure 1:
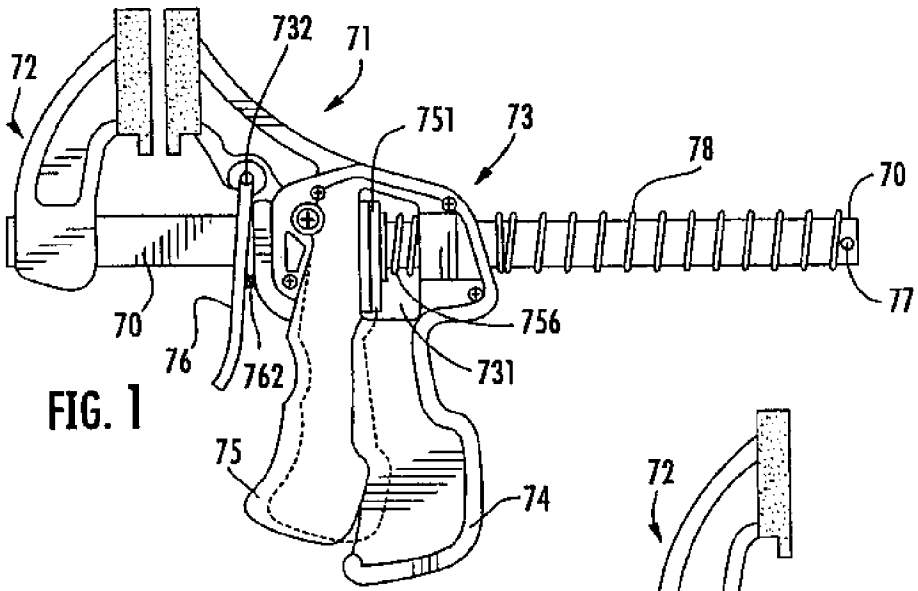
FIG. 1 is a side view of an auto-advance bar clamp in a nearly closed position.
Figure 2:
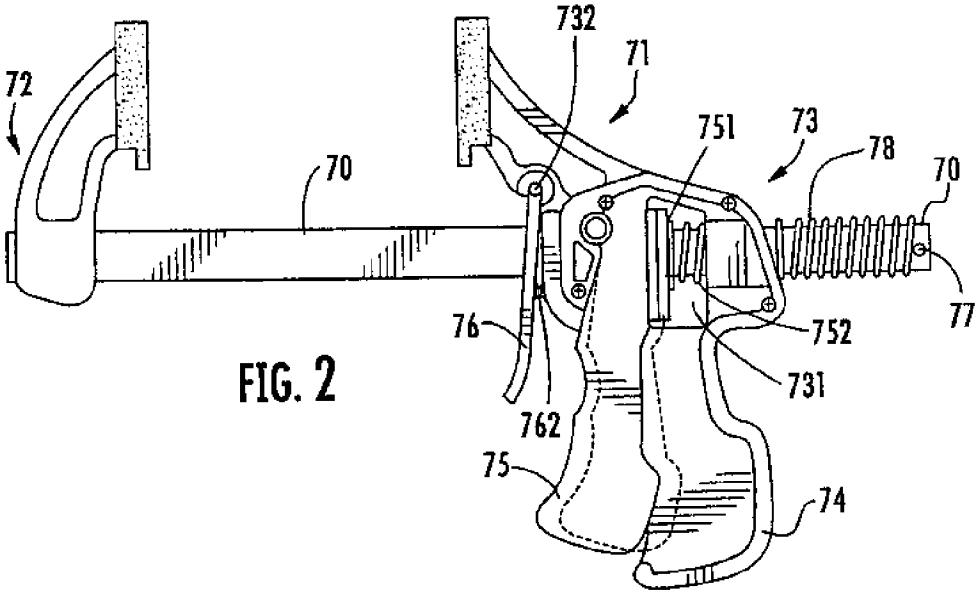
FIG. 2 is a view of the FIG. 1 clamp shown in an open position.
Figure 3:
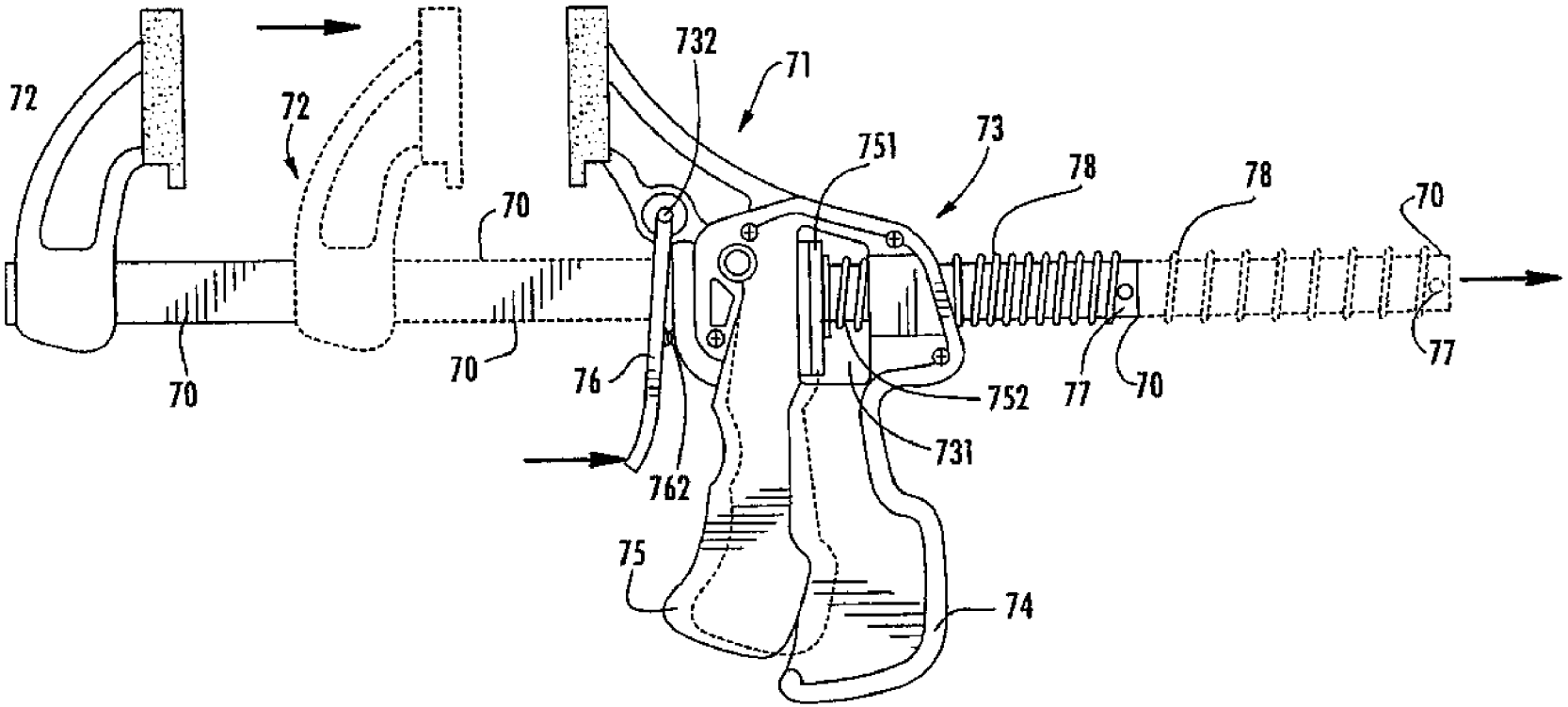
FIG. 3 is a view of the FIG. 1 and FIG. 2 clamp showing motion.

A one-handed bar clamp used for clamping work pieces together whereupon the push of the brake (76) lever the clamp instantly and automatically adjusts from a wide open position to any desired closed position is provided. With reference to FIGS. 1, 2 and 3 the auto-advance bar clamp comprises a slide bar (70), a stationary jaw (71), a movable jaw (72), a body (73), a drive assembly and a brake (76), an advancement spring (78) and a roll pin (77). The moveable jaw (72) opposes the stationary jaw (71) and is mounted at one end of the spring (78) loaded slide bar (70) and is movably supported through a bore (not numbered) which passes through the body (73). The slide bar (70) has a top edge and a bottom edge.

The body (73) has a top, a bottom, a front edge, a back edge, a cavity (731), a bore (not numbered), a transverse hole (732) and a handle (74). The stationary jaw (71) is formed on the top of the body (73). The cavity (731) is defined in the body (73) and divides the bore, the slide bar (70) passes through the cavity (731) and the bore. The transverse hole (732) is formed in the front edge of the body above the slide bar (70). The handle (74) is formed at the bottom of the body (73).

The drive assembly comprises a trigger (75), a drive lever (751) and a spring (752). The trigger (75) has a top, a bottom, a front edge and a rear edge and is pivotally mounted in the body (69) corresponding to the handle (74) so the top of the trigger (75) is in the cavity (731). The upper end of the trigger (75) is forked and straddles the slide bar (70). The handle (74) is hollow in part so as to receive the basically U-shaped trigger (75) when the trigger (75) is squeezed it straddles the handle (74). The drive lever (751) has a front surface, a rear surface and a hole (not numbered) through which the slide bar (70) passes, is suspended on the slide bar (70) and abuts the rear edge of the trigger (75). The hole of the drive lever (751) has a top edge and a bottom edge. The spring (752) has two ends and is mounted around the slide bar (70) in the cavity (731). One end of the spring (752) abuts the drive lever (751), and the other abuts an interior surface of the cavity (731) so the drive lever (751) is pushed to a non-gripping standby position substantially perpendicular to the slide bar (70). The trigger (75) is also pushed by the spring (752) to the standby position.

The brake (76) has a central hole and is pivotally attached to the transverse hole (732) in the front edge of the body (73). The slide bar (70) passes through the central hole in the brake (76). The central hole in the brake (76) has a top edge and a bottom edge. A compression spring (762) is mounted between the brake (76) and the front edge of the body (73) so the brake (76) is pushed to a gripping inclined standby position. The advancement spring (78) has two ends and is mounted around the slide bar (70). One end of the advancement spring (78) abuts the back edge of the body (73) and the other abuts a roll pin (77) which is pressed through a hole at the end of the slide bar (70) opposite the movable jaw (72). When the movable jaw (72) is furthest from the body (73) the clamp is in the open position and the advancement spring (78) is fully compressed, at lesser openings the advancement spring (78) is compressed relative to the degree of spacing between the movable jaw (72) and the front of the body (73). When the movable jaw (72) is closed and nearest the body (73) the advancement spring (78) is expanded however it is never fully expanded requiring greater overall length to fully close the clamp. The advancement spring (78) applies enough force to completely close the clamp from any open position but not enough force to overcome the grip of the brake (76).

To advance the movable jaw (72) in small increments toward the stationary jaw (71), the trigger (75) is squeezed toward the handle (74), and the trigger (75) pivots the drive lever (751). The hole in the drive lever (751) is inclined so the top and bottom edge of the hole grip the top and bottom of the slide bar (70) and push the slide bar (70) back. As the drive lever (751) pushes the slide bar (70) back, the movable jaw (72) moves toward the stationary jaw (71). The slide bar (70) is kept from moving forward, or unintentionally backward by the brake (76) because the central hole in the brake (76) grips the top edge and the bottom edge of the slide bar (70) when the trigger is released. The compression spring (762) keeps the brake (76) in position to grip the slide bar (70) to prevent the slide bar (70) from moving forward or unintentionally backward.

To instantly close the clamp and advance the movable jaw (72) from any open position, toward the stationary jaw (71), the brake (76) is momentarily released. Instantly upon release of the brake (76) the advancement spring (78) expands and pushes against the back edge of the body (73) and the roll pin (77) the spring loaded slide bar (70) now free from the grip of the brake (76) is forced back by the advancement spring (78) closing the clamp. Squeezing the trigger (75) tightens the clamp. With the movable jaw (72) and the stationary jaw (71) spaced apart the clamp can be closed incrementally by squeezing the trigger (75) or instantly by releasing the brake (76).

Figure 3A:
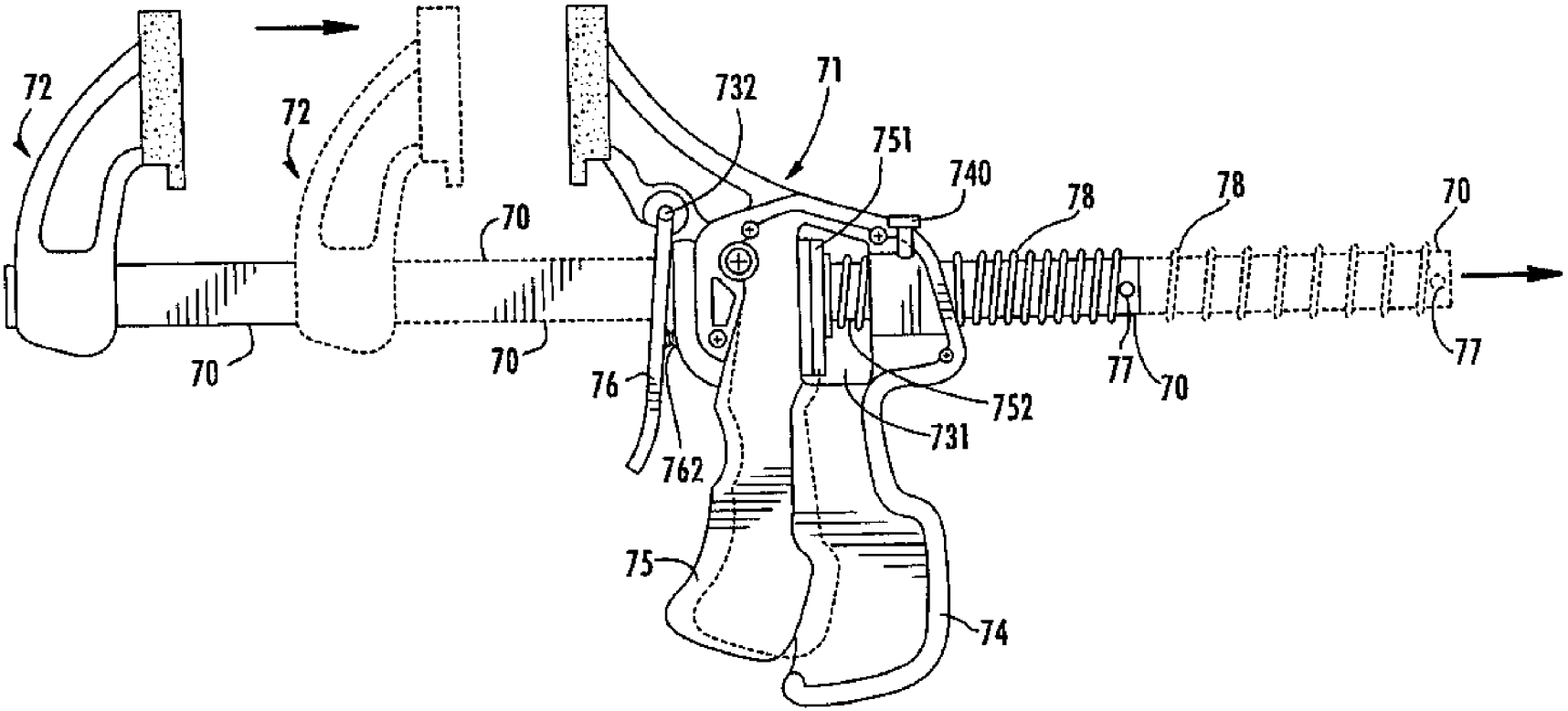
FIGS. 3A and 3B are alternate embodiments of the FIGS. 1-3 clamp with an added advancement adjustment screw.

Referring to FIG. 3A, an alternate embodiment of the clamp shown in FIGS. 1-3 provides an adjusting screw (740) which threads through the body (71) at a location that permits the tip of the adjusting screw (740) to frictionally contact the slide bar (70), the screw entry into the body (73) may be angular (not shown) to the slide bar (70) such that the tip of the adjusting screw (740) is closer to the movable jaw (72) than the screw head. Such location also permits the user to access and rotate the head of the adjusting screw (740) increasing or decreasing the friction between the tip of the adjusting screw and the slide bar thereby regulating the advancement speed of the movable jaw (72) when the brake (76) is released.

A bushing surface (not shown) may be included at the tip of or between the tip of the adjusting screw (740) and the slide bar (70) to prevent wear upon the surfaces. Although shown only in this embodiment such adjustment can be incorporated into other embodiments of the auto-advance bar clamp.

Figure 3B:
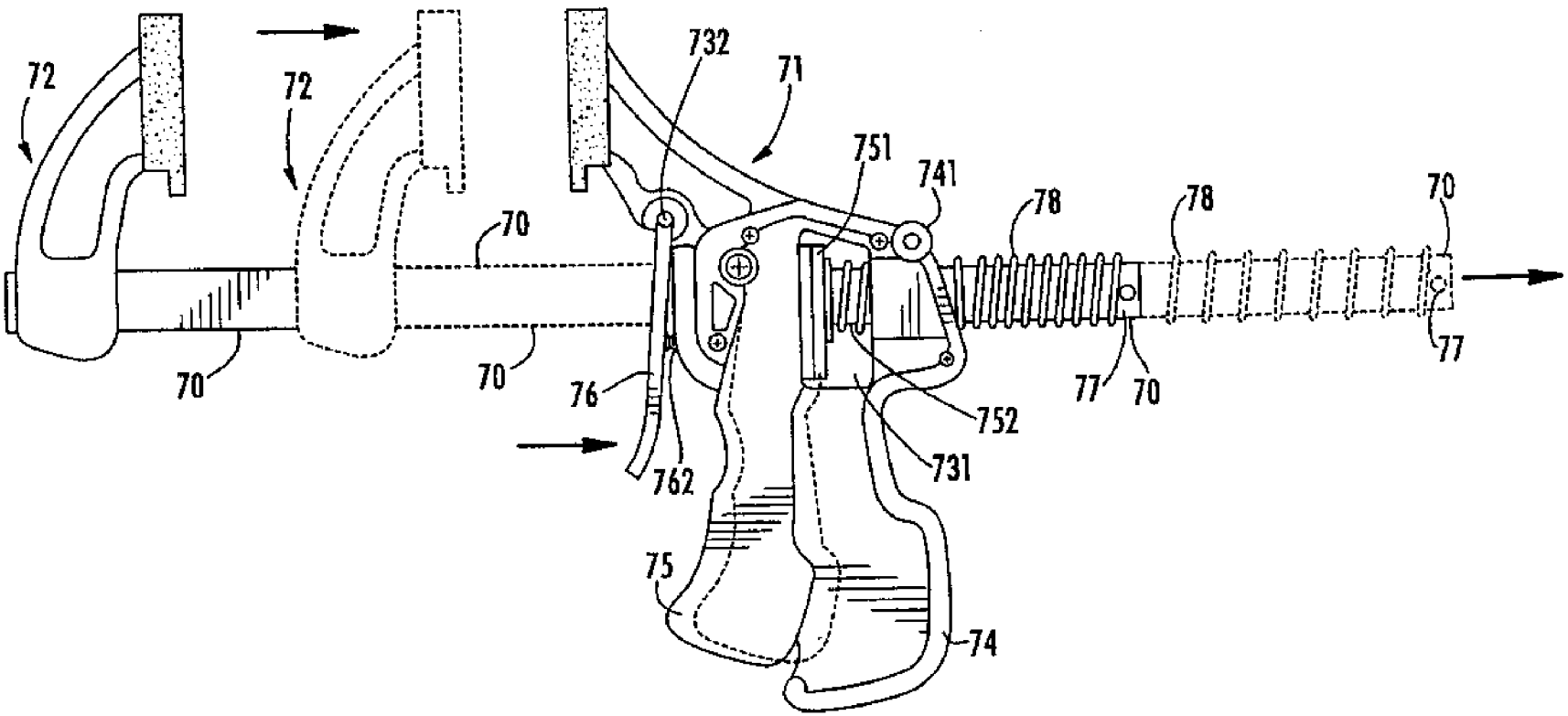

Referencing FIG. 3B one half of the bore may be split lengthwise, one half containing a hole (not shown), a screw (741) passes though the hole and threads into a hole in the other side of the split bore. Tightening or loosening the screw (741) alters the interior size of the split bore making it larger or smaller, increasing or decreasing the friction between the interior walls of the bore and the slide bar (70) providing adjustment of the advancement speed of the movable jaw (72).

Figure 4:
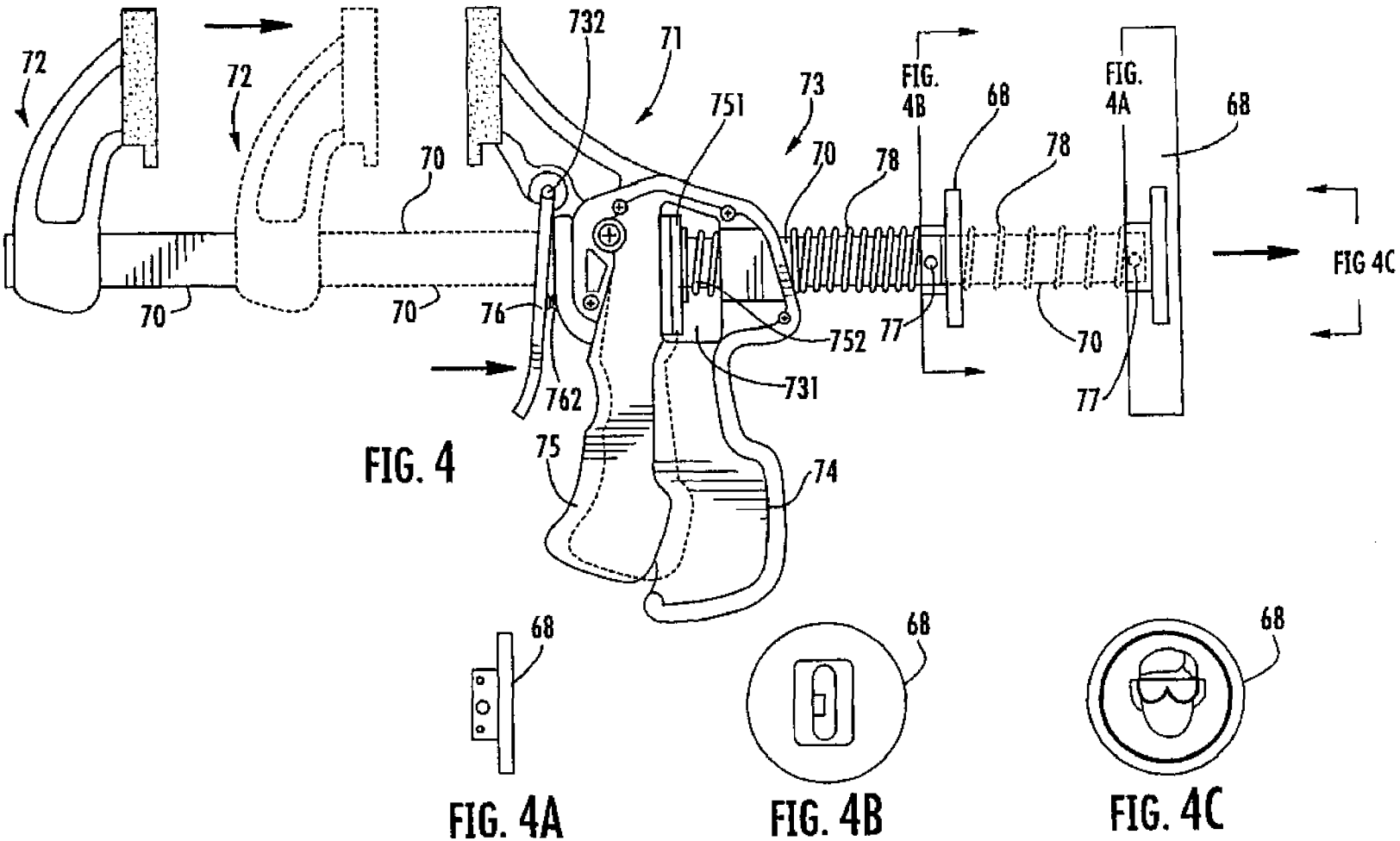
FIG. 4 is a view of the FIGS. 1-3 clamp shown with an alternate embodiment end cap attached to the end of the slide bar.

Another alternate embodiment of the clamp shown in FIG. 4 provides an end cap (68) attached or formed at the end of the slide bar (70) it may be formed to snap onto the roll pin (77) or it may be formed to snap into the roll pin (77) hole (not numbered) at the end of the slide bar (70). Although FIGS. 4A, 4B and 4C show a side, a front and a back view of a specific end cap (68) the form and attachment of end cap (68) to the slide bar (70) may vary.

Figures 5, 6:
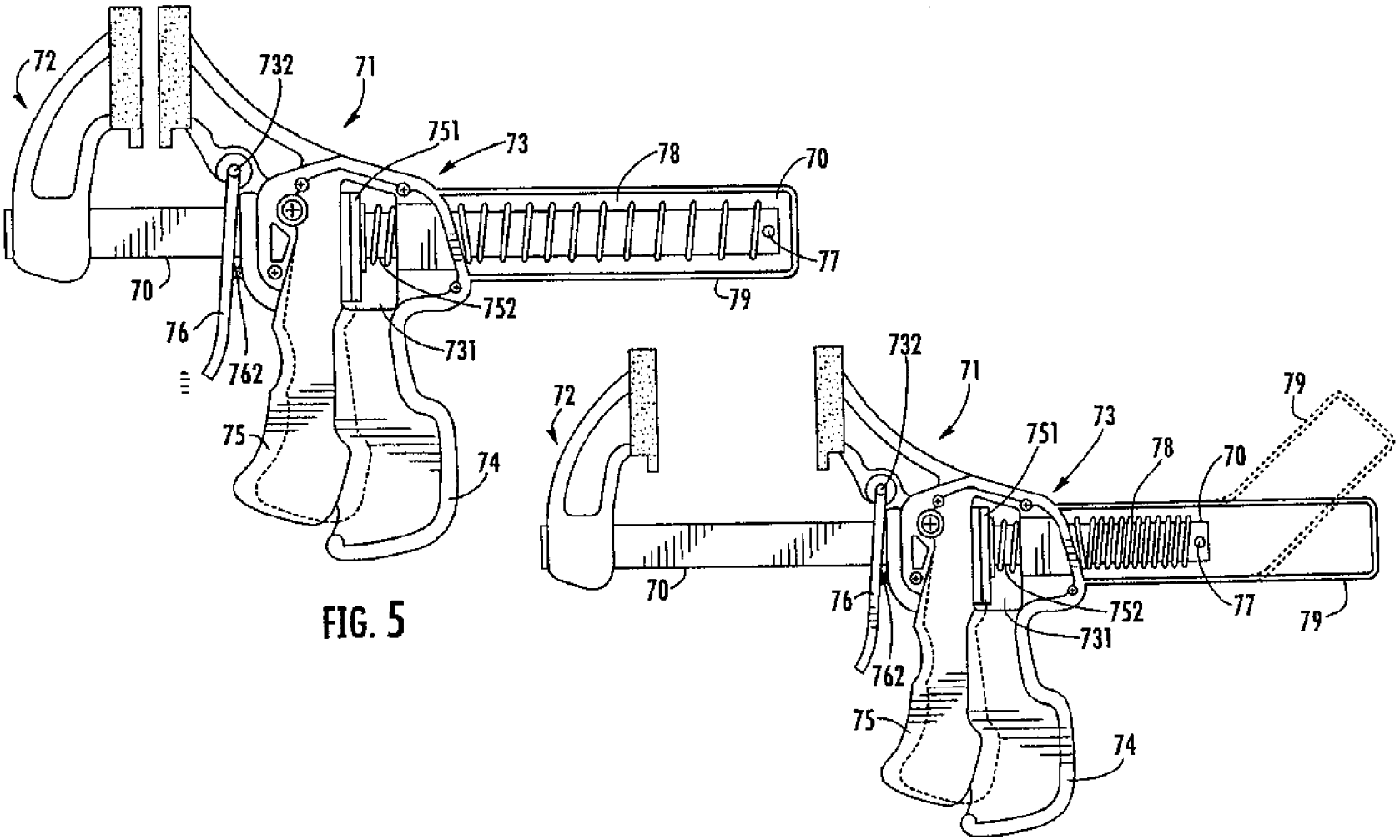
FIG. 5 is a side view of the FIGS. 1-3 clamp showing an alternate embodiment with a guard.
FIG. 6 is a view of the FIG. 5 clamp in a partially open position showing a resiliently flexible guard.
Figure 7:
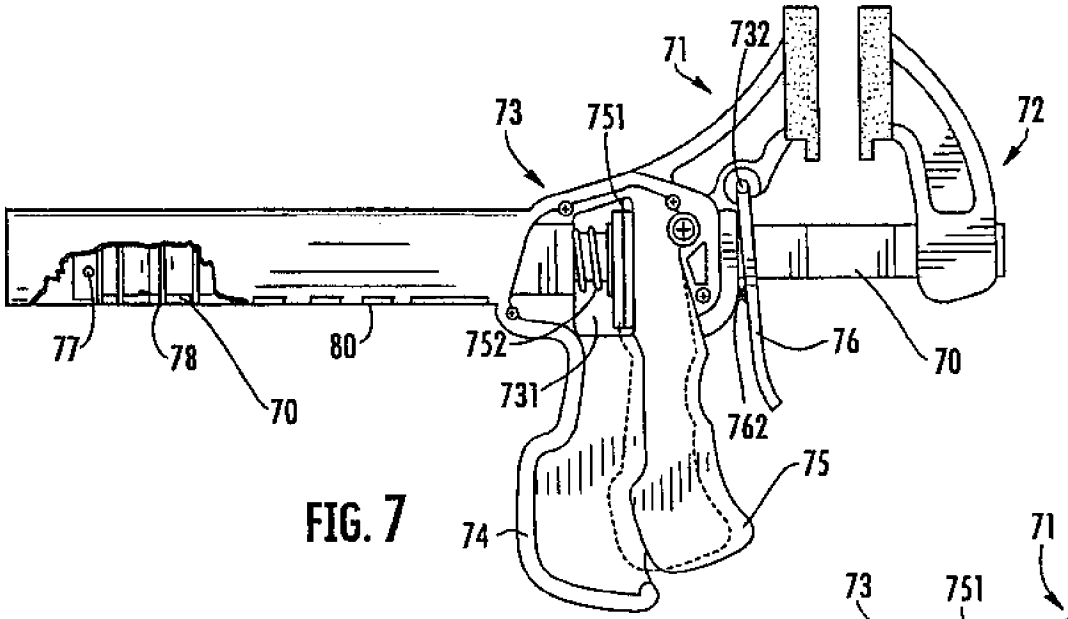
FIG. 7 is a side view (with a cutaway section for clarity) of an alternate embodiment shown in a nearly closed position showing a guard.
Figure 8:
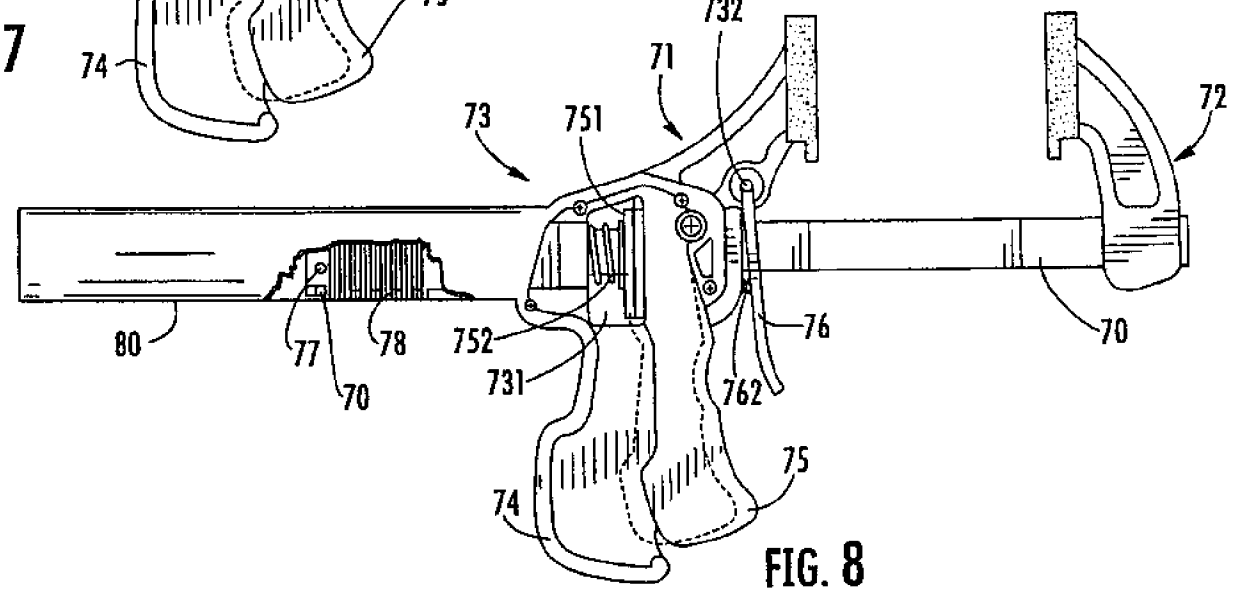
FIG. 8 is a side view of the clamp of FIG. 7 (with a cutaway section for clarity) shown in a more opened position.

Yet another alternate embodiment of the clamp shown in FIG. 5 provides a guard (79) which partially covers the slide bar (70) and advancement spring (78). The guard (79) may be rigid or resiliently flexible as shown in FIG. 6. The guard (79) may be formed as pan of the body (73) or may be attached to the body (73) as a separate part or parts. With the clamp in the completely closed position with the movable jaw (72) and the stationary jaw (71) touching, the guard (79) while maintaining clearance between the advancement spring (78) extends back from the body (73) substantially parallel along the top edge of the slide bar (70) beyond and around the end of the slide bar (70) and returns substantially parallel along the bottom edge of the slide bar (70) and connects back to the body (73). In the alternative (not shown) the guard (79) may extend in the same manner along the sides of the slide bar (70) instead of along the top and bottom edges of the slide bar (70). Additionally, the guard (79) (not shown) may extend on at least one long side or edge of the slide bar (70) to or beyond or beyond and around the end of the slide bar (70) when the clamp is in the completely closed position. In yet another alternate embodiment of the clamp shown in FIGS. 7 and 8 provides a guard (80) which may be rigid or resiliently flexible. The guard (80) may be formed as part of the body (73) or may be attached to the body (73) as a separate part or parts. With the clamp in the completely closed position with the movable jaw (72) and the stationary jaw (71) touching, the guard (80) while maintaining clearance between advancement spring (78) and the interior surfaces of the guard (80) extends back from the body (73) to at least the end of the slide bar (70). The guard (80) may be of channel, tubular or other cross section.

Figure 13:
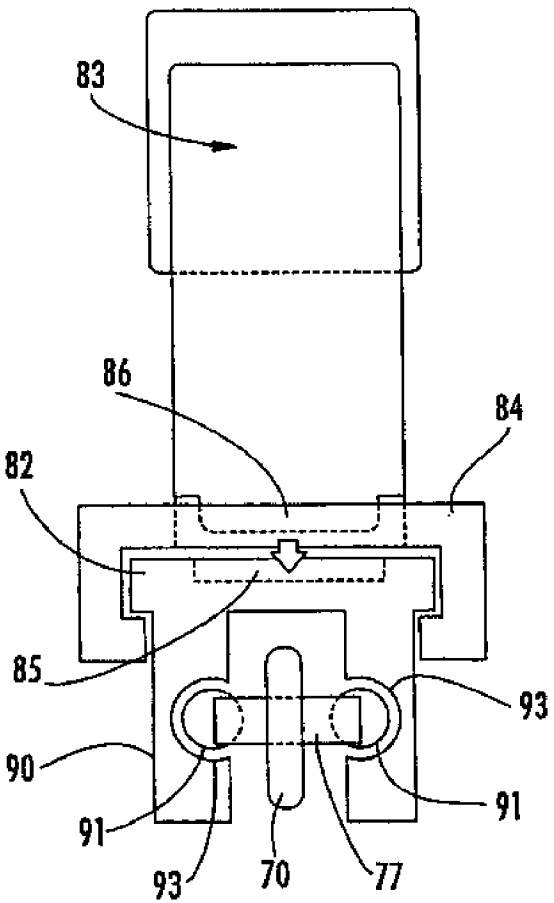
FIG. 13 is a cross section end view similar to that shown in FIG. 12B with an alternate advancement spring arrangement.
Figure 15:
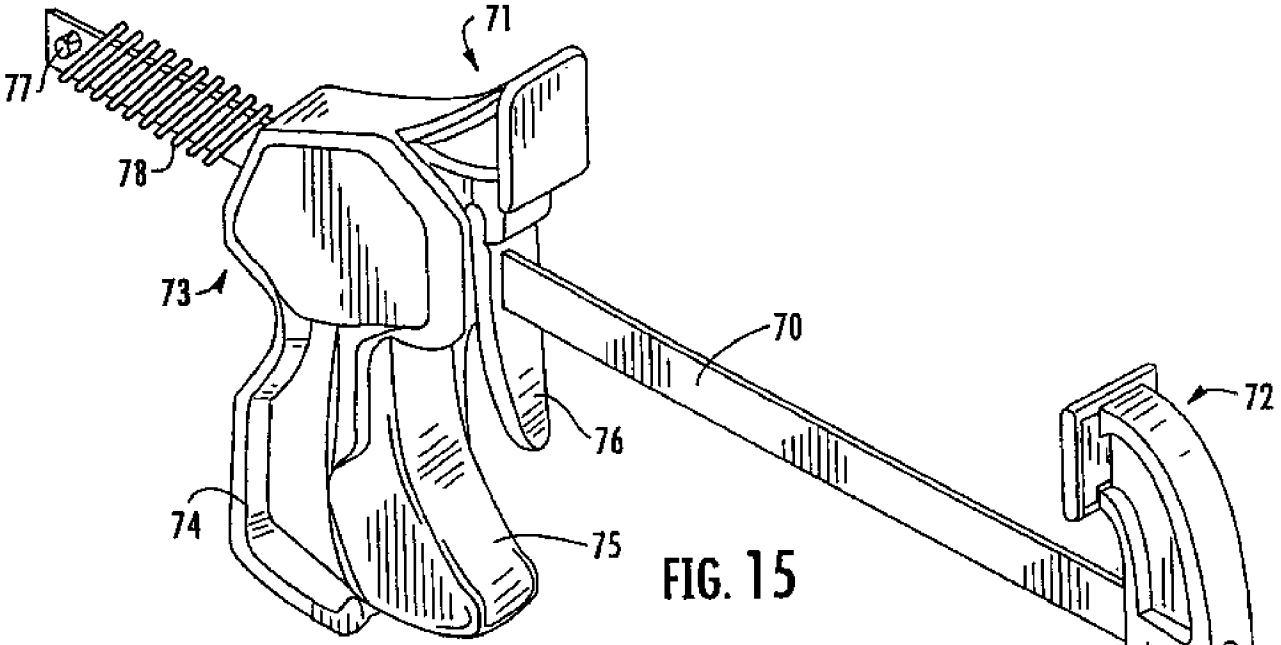
FIG. 15 is a perspective view of the clamp shown in FIGS. 1-3.
Figure 16:
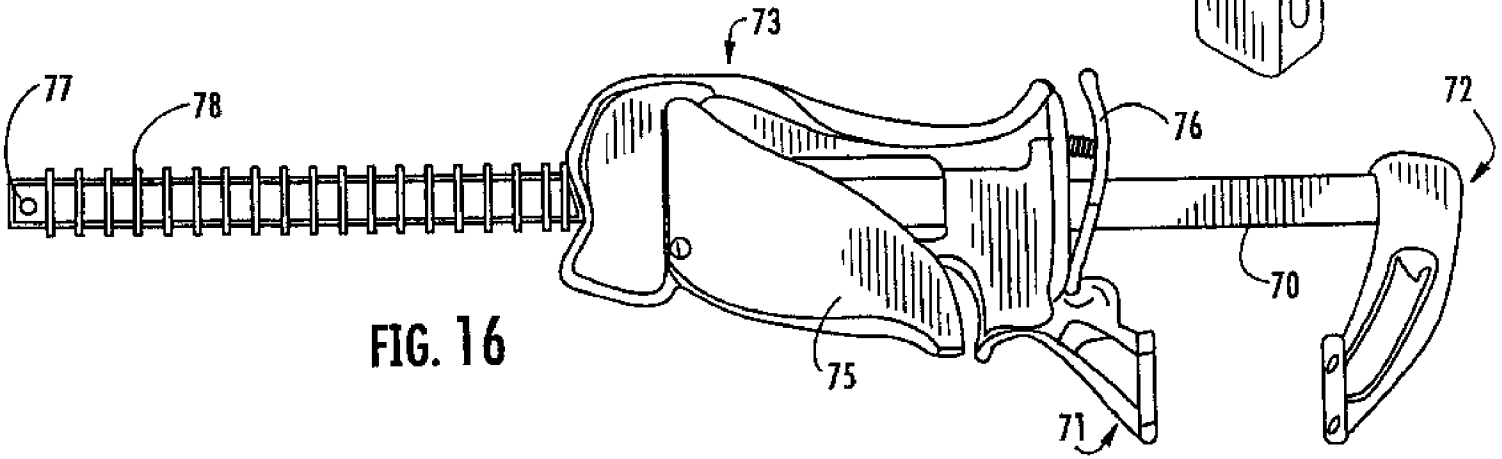
FIG. 16 is a perspective view of an alternate embodiment of the Auto-advance bar clamp.

FIG. 13 shows a cross section end view looking along the same lines as referenced in FIG. 12B. Illustrated is an example of an alternate advancement spring (91) arrangement partially contained within slots (93) formed within the interior walls of the rigid structural body extension (90). Although shown using two springs (91) similar arrangement may use only one (not shown).

Figure 14:
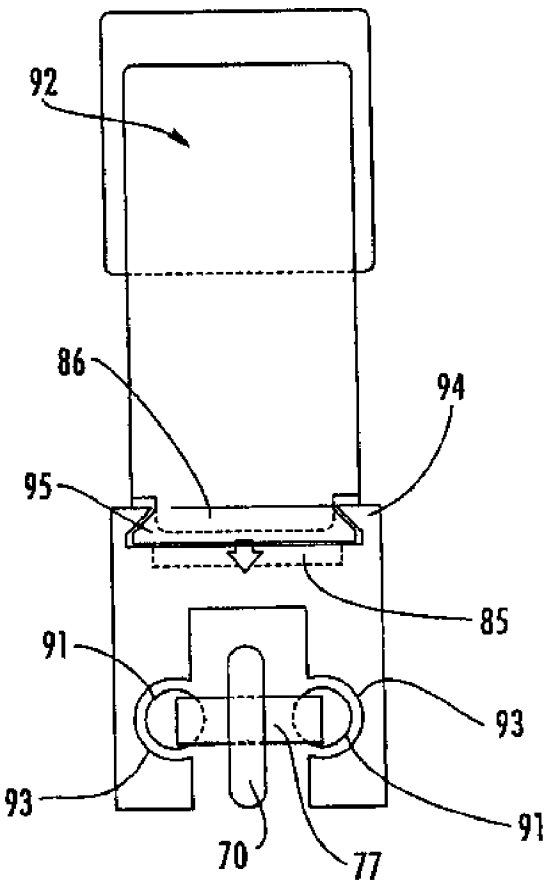
FIG. 14 is a cross section end view of an alternate sliding jaw and shown with the same alternate advancement spring arrangement as FIG. 13.

FIG. 14 is a view similar to that shown in FIG. 13. In this alternate example the rigid structural body extension (94) is formed with a dovetail shaped slide rail slot (96) which may mate with the dovetail shaped jaw base (95).

In operation of the auto-advance bar clamp the user grips the handle (74) with one hand and releases and holds the brake (76) lever, with the other hand the user grips the movable jaw (72) pulling it away from the stationary jaw (71) to the open most position with the greatest distance between the movable jaw (72) and the stationary jaw (71). The brake (76) is then released and the clamp will remain in the wide open position. At this point there is no longer any need for two hands to operate the clamp and the user now has a free hand to hold the work.

After positioning the clamp around the work, usually with the stationary jaw (71) touching the work, the user simply presses the brake (76) lever. Instantly upon release of the brake (76) the movable jaw (72) will automatically close upon whatever size work is between the jaws of the clamp. Once closed upon the work the user squeezes the trigger (75) to tighten the clamp.

To loosen and remove the clamp the user again releases and holds the brake (76) and "reloads" the clamp by opening the jaws to the open most position and then releases the brake (76) thus preparing the clamp for the next application. Often the clamp can also be "reloaded" with only one hand by using the work itself to bold the movable jaw (72) while removing and reopening the clamp. The multi-range auto-advance bar clamp is operated in exactly the same manner except in this embodiment the sliding jaw is positioned at the proper location along the slide rail (82) based upon the size of the work. The sliding jaw (83) is moved by slightly tilting it forward and then sliding it to the desired location along the slide rail (82) and passively allowing the projection (86) to resiliently snap into the desired slot (85).

The invention claimed is:

1. A bar clamp comprising:

a body including a rigid extension;

a slide bar having an end slidably mounted to the body, said rigid extension being positioned proximate to the slide bar and having an end located at least at the end of the slide bar;

a first jaw mounted on the slide bar;

a second jaw mounted on the body in opposed relationship to the first jaw;

a drive mechanism for moving the slide bar in a first direction;

a brake movable between an engaged position and a disengaged position where when the brake is in the engaged position the slide bar is prevented from moving in a second direction opposite to the first direction; and means for automatically moving the slide bar in the first direction when the brake is in the disengaged position, wherein said means for automatically moving the slide bar is located within the rigid extension.

2. The bar clamp of claim 1 wherein the means for automatically moving includes a spring.

3. The bar clamp of claim 1, wherein the said means for automatically moving the slide bar is disposed within the rigid extension between the end of the slide bar and the end of the rigid extension.

4. A bar clamp comprising:

a body;

a slide bar slidably mounted to the body;

a first jaw mounted on the slide bar;

a second jaw mounted on the body in opposed relationship to the first jaw;

a drive mechanism for moving the slide bar in a first direction;

a brake movable between an engaged position and a disengaged position where when the brake is in the engaged position the slide bar is prevented from moving in a second direction opposite to the first direction;

a spring for automatically moving the slide bar in the first direction when the brake is in the disengaged position; and a guard for covering the spring and slide bar, said guard extending from the body to at least the end of the slide bar.

5. The bar clamp of claim 4, wherein the slide bar includes a first portion supporting the first jaw and a second portion extending from the body opposite the first jaw, said guard completely covers the second portion of the slide bar.

6. The bar clamp of claim 4, wherein the slide bar includes a first portion supporting the first jaw and a second portion extending from the body opposite the first jaw, said guard partially covers the second portion of the slide bar.

7. The bar clamp of claim 4, wherein the guard is rigid.

8. The bar clamp of claim 4, wherein the guard is flexible.

9. The bar clamp of claim 4, wherein the guard is attached to the body.

10. The bar clamp of claim 4, wherein the guard is formed as part of the body.

11. A bar clamp comprising:

a body;

a slide bar slidably mounted to the body;

a first jaw mounted on the slide bar;

a second jaw mounted on the body in opposed relationship to the first jaw, said second jaw being slidably repositionable relative to the body;

a drive mechanism for moving the slide bar in a first direction;

a brake movable between an engaged position and a disengaged position where when the brake is in the engaged position the slide bar is prevented from moving in a second direction opposite to the first direction;

a spring for automatically moving the slide bar in the first direction when the brake is in the disengaged position; and a guard for covering the spring and slide bar, said guard extending from the body to at least the end of the slide bar.

12. The bar clamp of claim 11, wherein the slide bar includes a first portion supporting the first jaw and a second portion extending from the body opposite the first jaw, said guard completely covers the second portion of the slide bar.

13. The bar clamp of claim 11, wherein the slide bar includes a first portion supporting the first jaw and a second portion extending from the body opposite the first jaw, said guard partially covers the second portion of the slide bar.

14. The bar clamp of claim 11, wherein the guard is rigid.

15. The bar clamp of claim 11, wherein the guard is flexible.

16. The bar clamp of claim 11, wherein the guard is attached to the body.

17. The bar clamp of claim 11, wherein the guard is formed as part of the body.

18. The bar clamp of claim 1, wherein said means for automatically moving the slide bar is disposed within the rigid extension between the body and the end of the slide bar.

* * * * *